US007898209B2

(12) United States Patent
Kim et al.

(10) Patent No.: US 7,898,209 B2
(45) Date of Patent: Mar. 1, 2011

(54) CLEANER AND METHOD FOR DRIVING THE SAME

(75) Inventors: Sang Young Kim, Gyeonggi-do (KR); Myung Keun Yoo, Seoul (KR); Kwang Woon Ahn, Seoul (KR); Hyoun Jeong Shin, Incheon (KR)

(73) Assignee: LG Electronics Inc., Seoul (KR)

( * ) Notice: Subject to any disclaimer, the term of this patent is extended or adjusted under 35 U.S.C. 154(b) by 590 days.

(21) Appl. No.: 11/866,750

(22) Filed: Oct. 3, 2007

(65) Prior Publication Data

US 2008/0297102 A1 Dec. 4, 2008

(30) Foreign Application Priority Data

Jun. 1, 2007 (KR) ..... 10-2007-0053851

(51) Int. Cl.
*H02P 27/04* (2006.01)

(52) U.S. Cl. ..... 318/803; 318/139; 318/800; 318/801

(58) Field of Classification Search ..... 15/319, 15/339; 318/124, 139, 148, 700, 400.01, 318/254.1, 267, 441, 800, 801, 803
See application file for complete search history.

(56) References Cited

U.S. PATENT DOCUMENTS 4,835,409 A * 5/1989 Bhagwat et al. ..... 307/64
5,243,732 A * 9/1993 Koharagi et al. ..... 15/319
6,448,732 B1 * 9/2002 Block ..... 318/635
7,292,004 B2 * 11/2007 Ueda et al. ..... 318/805
2002/0121000 A1 9/2002 Tyler
2005/0262660 A1 12/2005 Yoo et al.
2007/0062744 A1 * 3/2007 Weidenheimer et al. ... 180/65.2

FOREIGN PATENT DOCUMENTS

CN 1154833 A 7/1997

OTHER PUBLICATIONS

U.S. Appl. No. 11/866,670 to Yoo et al., which was filed Oct. 3, 2007.
U.S. Appl. No. 11/866,105 to Yoo et al, which was filed Oct. 2, 2007.

* cited by examiner

*Primary Examiner*—Walter Benson
*Assistant Examiner*—Antony M Paul
(74) *Attorney, Agent, or Firm*—McKenna Long & Aldridge LLP

(57) ABSTRACT

A cleaner that can automatically respond to a change in an AC voltage and a voltage of a battery. In the motor, a motor for rotating a collecting fan is driven by a motor driver. The motor driver drives the motor using a voltage from a voltage selector. The voltage selector switches between a low-level voltage of the battery and a high-level voltage derived from the AC voltage to be supplied to the motor driver.

18 Claims, 5 Drawing Sheets

CLEANER AND METHOD FOR DRIVING THE SAME

FIELD OF THE INVENTION

The present disclosure relates to a power control system for controlling a voltage supplied to a motor. More particularly, the present disclosure relates to a power control system for controlling a voltage supplied to a motor for use in a vacuum cleaner.

BACKGROUND

The present disclosure relates to a cleaner for collecting pollutant particles such as dust and dirt and a method for driving the cleaner.

A cleaner makes it possible to clean a desired region without scattering pollutant particles such as dust and dirt. The reason for this is that the cleaner collects (or traps) pollutant particles by inhalation (suction). In order to collect pollutant particles, the cleaner has a collecting fan that is rotated by an electric motor.

The cleaner uses an AC voltage of about 110 V or 220 V or a DC voltage of a battery to drive the collecting fan. That is, cleaners are classified into an AC voltage cleaner and a DC voltage cleaner.

The AC voltage cleaner is equipped with a power cord for receiving the AC voltage. This power cord, however, restricts a possible cleaning region that can be cleaned using the cleaner. Thus, when a wide region needs to be cleaned, a user of the cleaner must repeat reconnection of the power cord.

The DC voltage cleaner restricts the possible time during which the cleaner may be used. In actuality, the DC voltage cleaner can be used only when a battery is charged with a voltage. Upon completion of discharge of the battery, the DC voltage cleaner cannot be used until the battery is charged with a voltage.

SUMMARY

Embodiments provide a cleaner that can be operated by a battery voltage as well as by an AC voltage, and a method for driving the cleaner.

Embodiments also provide a cleaner whose AC and DC voltage modes can be automatically switched, and a method for driving the cleaner.

Embodiments also provide a cleaner whose battery can be actively charged.

In one embodiment, a cleaner includes: a motor for rotating a collecting fan; a battery; a voltage converter for converting an AC voltage received from a power source into a DC voltage; an active voltage selector for selecting a voltage of the battery and the DC voltage; and a motor driver for driving the motor using the voltage selected by the active voltage selector.

In another embodiment, a cleaner includes a motor for rotating a collecting fan; a battery; a voltage converter for converting an AC voltage received from a power source into a DC voltage; a motor driver for driving the motor using one of a voltage of the battery and the DC voltage depending on whether the AC voltage is received; and a forcible interrupter for temporarily disconnecting the motor driver from the motor depending on whether the AC voltage is received.

In further another embodiment, a method for driving a cleaner includes converting an AC voltage received from a power source into a DC voltage; actively switching a voltage of a battery and the DC voltage selectively; and driving a motor using the actively-switched voltage.

The method may further include detecting whether the AC voltage is received. In this case, the driving of the motor include: dropping the actively switched voltage; and generating at least two phase voltage signals to be provided to the motor, by using one of the dropped voltage and the actively switched voltage depending on the detection results for the AC voltage.

The details of one or more embodiments are set forth in the accompanying drawings and the description below. Other features will be apparent from the description and drawings, and from the claims.

BRIEF DESCRIPTION OF THE DRAWINGS

The accompanying drawings are intended to provide a further understanding of the present disclosure. In the drawings.

DETAILED DESCRIPTION OF THE EMBODIMENTS

Reference will now be made in detail to the embodiments of the present disclosure, examples of which are illustrated in the accompanying drawings. Wherever possible, the same reference numbers will be used throughout the drawings to refer to the same or like parts.

Figure 1:
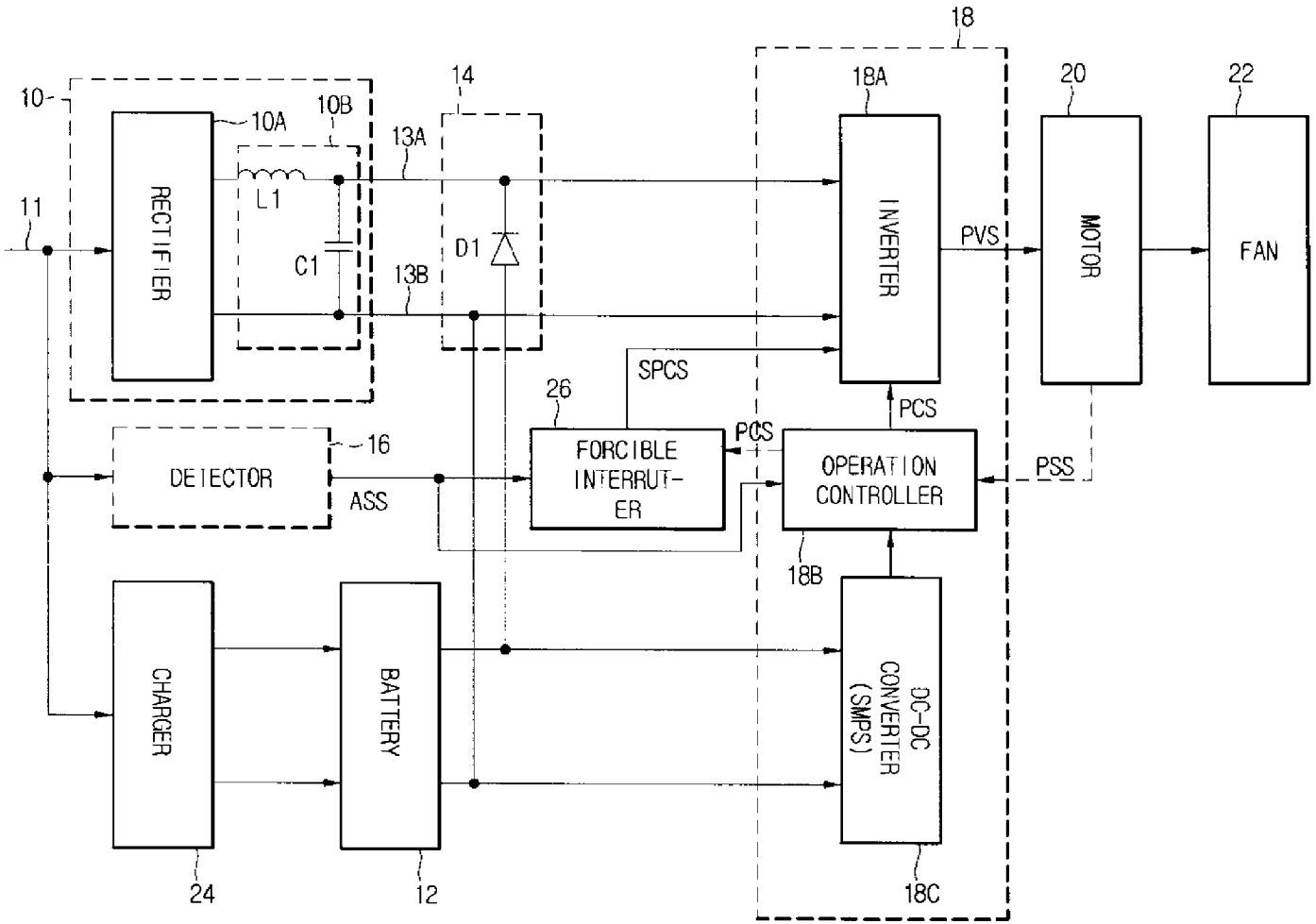
FIG. 1 is a block diagram of a cleaner according to an embodiment.

FIG. 1 is a block diagram of a cleaner according to an embodiment.

Referring to FIG. 1, the cleaner includes a battery 12 and an AC-DC converter 10 for converting an AC voltage into a DC voltage. The AC voltage is received from a conventional source, such as, for example, a power utility company, a power generator, or any other entity and/or device capable of generating an AC voltage.

The AC-DC converter 10 converts an AC voltage (e.g., 220 V), which is received from a power cord 11, into a DC voltage. The power cord 11 transmits the AC voltage received from a voltage source (not illustrated) to the AC-DC converter 10. When the AC voltage is provided through the power cord 11, an output DC voltage of the AC-DC converter 10 (hereinafter referred to as "first DC voltage") has a high voltage level of about 310 V. For this voltage conversion, the AC-DC converter 10 includes a rectifier 10A and a smoother 10B connected in series to the power cord 11. The rectifier 10A full-wave rectifies or half-wave rectifies the AC voltage received from the power cord 11, thereby outputting a ripple voltage. The smoother 10B smoothes the ripple voltage from the rectifier 10A to generate the first DC voltage. To this end, the smoother 10B includes a choke coil L1 connected between a high-voltage line 13A and a high-voltage output terminal of the rectifier 10A, and a capacitor C1 connected between the high-voltage line 13A and a base-voltage line 13B. The choke coil L1 suppresses a ripple component contained in the ripple voltage that will be provided from the high-voltage output terminal of the rectifier 10A to the high-voltage line 13A. The capacitor C1 is charged and discharged depending on the suppressed ripple voltage from the choke coil L1 such that the first DC voltage of about 310 V is applied on the high-voltage line 13A. The first DC voltage output from the smoother 10B is provided to an active voltage selector 14.

The battery 12 supplies its charged DC voltage to the active voltage selector 14. The charged DC voltage of the battery 12 (hereinafter referred to as "second DC voltage") has a low voltage level of about 28 to 50 V. In order to generate the second DC voltage with a low voltage level of about 28 to 50 V, the battery 12 includes about 24 to 30 charge cells. Ni-MH charge cells may be used as the charge cells of the battery 12.

The active voltage selector 14 monitors whether the first DC voltage is received from the AC-DC converter 10. Depending on whether the first DC voltage is received, the active voltage selector 14 provides one of the second DC voltage from the battery 12 and the first DC voltage from the AC-DC converter 10 to an inverter 18A of a motor driver 18. When the first DC voltage is not received from the AC-DC converter 10 (i.e., in a DC voltage mode), the active voltage selector 14 provides the second DC voltage from the battery 12 to the inverter 18A of the motor driver 18. On the other hand, when the first DC voltage is received from the AC-DC converter 10 (i.e., in an AC voltage mode), the active voltage selector 14 provides the first DC voltage to the inverter 18A of the motor driver 18. To this end, the active voltage selector 14 includes a unidirectional element (for example, diode D1) that is connected between a high-voltage output terminal of the battery 12 and the high-voltage line 13A (specifically, a connection node between the choke coil L1 and a high-voltage input terminal of the inverter 18A). When a voltage on the high-voltage line 13A is higher than a voltage on the high-voltage output terminal of the battery 12 (i.e., in the AC voltage mode where the first DC voltage is provided to the high-voltage line 13A), the diode D1 is turned off to interrupt the second DC voltage to be provided from the battery 12 to the inverter 18A. At this point, the first DC voltage is provided from the AC-DC converter 10 to the inverter 18A. On the other hand, when a voltage on the high-voltage line 13A is lower than a voltage on the high-voltage output terminal of the battery 12 (i.e., in the DC voltage mode where the first DC voltage is not provided to the high-voltage line 13A), the diode D1 is turned on to provide the second DC voltage from the battery 12 to the inverter 18A. The active voltage selector 14 may further include an additional diode that is connected between the choke coil L1 and the high-voltage line 13A (specifically, a connection node between the diode D1 and the high-voltage input terminal of the inverter 18A). The additional diode prevents the second DC voltage from the battery 12 from leaking to the AC-DC converter 10, thereby increasing the available time (i.e., the discharge period) of the battery 12.

The cleaner further includes a detector 16 connected to the power cord 11, and a serial circuit of a motor 20 and a collecting fan 22 connected the motor driver 18. The detector 16 detects whether the AC voltage is supplied through the power cord 11. Depending on the detection results, the detector 16 provides a controller 18B of the motor driver 18 with an AC voltage detection signal ASS having one of a high logic voltage and a low logic voltage (i.e., a base voltage). When the AC voltage is supplied through the power cord 11, the detector 16 provides the controller 18B with an AC voltage detection signal ASS with a high logic voltage for indicating or designating the AC voltage mode. On the other hand, when the AC voltage is not supplied through the power cord 11, the detector 16 provides the controller 18B with an AC voltage detection signal ASS with a low logic voltage for indicating or designating the DC voltage mode. To this end, the detector 16 includes a diode for rectification and resistors for voltage division. Alternatively, the detector 16 may detect a voltage on an output terminal of the AC-DC converter 10 to determine whether the AC voltage is supplied. In this case, there may be an error in the determination by the detector 16 or the circuit configuration of the detector 16 may be complex.

Further alternatively, the detector 16 may be implemented using a program operating in the controller 18B. In this case, the controller 18 may be electromagnetically connected to the power cord 11.

Depending on the logic voltage levels of the AC voltage detection signal ASS from the detector 16, the motor driver 18 drives the motor 20 in one of a pulse width modulation (PWM) mode and a pulse trigger mode. When the AC voltage detection signal ASS of a high logic voltage is received from the detector 16 (i.e., in the AC voltage mode), the motor driver 18 drives the motor 20 in a pulse trigger mode so that an average voltage provided to the motor 20 can be about 28 to 50 V that is identical to the second DC voltage from the battery 12. That is, when the AC voltage is supplied (i.e., in the AC voltage mode), the motor driver 18 drops the first DC voltage of about 310 V from the AC-DC converter 10 to about 28 to 50 V (i.e., the second DC voltage from the battery 12). In this case, the period of a trigger pulse applied to the motor 20 is minutely increased/decreased depending on the rotation period (or rotation speed) of the motor 20 while the width of the trigger pulse is maintained at a constant value independent of the rotation period of the motor 20, thereby adjusting the rotation speed (i.e., the rotational force) of the motor 20. On the other hand, when the AC voltage detection signal ASS of a low logic voltage is received from the detector 16 (i.e., in the DC voltage mode), the motor driver 18 drives the motor 20 in a PWM mode so that the second DC voltage from the battery 12 is used, as it is, to drive the motor 20. The rotation speed of the motor 20 may be adjusted according to the duty rate of a PWM component. When the duty rate of the PWM component increases, the rotation speed (i.e., the rotational force) of the motor 20 increases. To the contrary, when the duty rate of the PWM component decreases, the rotation speed (i.e., the rotational force) of the motor 20 decreases. In order to adjust the rotation speed (i.e., the rotation force) of the motor 20, the motor driver 18 may respond to key switches for output selection (not illustrated).

In order to generate a phase voltage signal PVS of PWM mode or pulse trigger mode to be provided to the motor 20, the motor driver 18 includes the controller 18B for controlling an inverting operation of the inverter 18A. Under the control of the controller 18B, the inverter 18A switches the selected DC voltage (i.e., the first or second DC voltage) from the active voltage selector 14 in a pulse trigger mode or a PWM mode to generate at least two phase voltage signals PVSs. In the DC voltage mode, the inverter 18A generates at least two phase voltage signals PVSs that have a PWM component at every predetermined period (e.g., the rotation period of the motor 20). The phase voltage signals PVSs have a PWM component in rotation. The duty rate of the PWM component is adjusted according to the rotation speed (or the rotational force) of the motor 20, which is set by a user. In the AC voltage mode, the inverter 18A generates at least two phase voltage signals PVSs that have a high trigger pulse at every predetermined period (e.g., the rotation period of the motor 20). The high trigger pulses of the phase voltage signals PVSs have a phase difference corresponding to "the number of 360°/phase voltage signals PVSs ". The width of the trigger pulse is fixed independently of the rotation period (or the rotation speed) of the motor 20, while the period of the trigger pulse is minutely adjusted according to the rotation period (or the rotation speed) of the motor 20, so that the motor 20 rotates at the speed set by the user (or generates the rotational force set by the user).

In response to the AC voltage detection signal ASS from the detector 16, the controller 18B provides the inverter 18A with at least two phase control signals PCSs that have a PWM component in rotation or have a trigger pulse at every predetermined period (e.g., the rotation period of the motor 20). In the DC voltage mode where the AC voltage detection signal ASS with a low logic voltage is generated by the detector 16, the phase control signals PCSs generated by the controller 18B alternately have a PWM component for a predetermined period (i.e., a period corresponding to "the number of 360°/phase voltage signals PVSs") per the rotation period of the motor 20. The duty rate of the PWM component is adjusted according to the desired rotation speed (or rotational force) of the motor 20. In the AC voltage mode where the AC voltage detection signal ASS with a high logic voltage is generated by the detector 16, the phase control signals PCSs from the controller 18B have one high trigger pulse per the rotation period of the motor 20. The high trigger pulses contained in the phase control signals PCSs have a phase difference corresponding to "the number of 360°/phase voltage signals PVSs". In addition, the width of the trigger pulse contained in each of the phase control signals PCSs may be fixed independently of the desired rotation speed (or rotational force) of the motor 20 while the period of the trigger pulse in each of the phase control signals PCSs may be minutely adjusted according to the desired rotation speed (or rotational force) of the motor 20. According to an increase or decrease in the rotation period of the motor 20, the trigger pulse with the fixed width and the minutely adjusted period changes the average level of the voltage supplied to the motor 20, thereby increasing or decreasing the rotational force of the motor 20. In order to generate the phase control signals PCSs, the controller 18B responds to at least two phase sensing signals PSSs from the motor 20. For example, the controller 18B generates the first phase control signal PCS on the basis of the first phase sensing signal PSS and also generates the second phase control signal PCS on the basis of the second phase sensing signal PSS. For example, in the AC voltage mode, the controller 18B controls a falling (or rising) edge of the first phase control signal PCS to coincide with a falling (or rising) edge of the first phase sensing signal PSS and also controls a falling (or rising) edge of the second phase control signal PCS to coincide with a falling (or rising) edge of the second phase sensing signal PSS. In the DC voltage mode, the controller 18B controls the first phase control signal PCS to contain a PWM component for a high-voltage (or low-voltage) period of the first phase sensing signal PSS and also controls the second phase control signal PCS to contain a PWM component for a high-voltage (or low-voltage) period of the second phase sensing signal PSS.

The controller 18B may respond to a start sensing signal and an operation sensing signal as well as to the phase sensing signals PSSs. On the basis of the start sensing signal, the controller 18B controls the trigger pulse period and the PWM component duty rate of the phase control signals PCSs to have a great value until the motor 20 rotates at a desired rotation speed. When the rotation speed of the motor 20 reaches the desired rotation speed, the controller 18B control the trigger pulse period and the PWM component duty rate of the phase control signals PCSs, which will be provided to the inverter 18A, to have a value corresponding to the desired rotation speed. On the basis of the period of the operation sensing signal, the controller 18B controls the trigger pulse period to have a value corresponding to the desired rotation speed. The phase of the operation sensing signal is earlier by 30° to 50° than the phase of the start sensing signal. The phase difference between the operation sensing signal and the start sensing signal is determined by the arrangement of a operation sensing sensor and a start sensing sensor included in the motor 20. For example, a central processing unit (CPU) or a microcomputer may be used as the controller 18B.

The motor driver 18 further includes a DC-DC converter 18C that is connected between the battery 12 and the controller 18B. The DC-DC converter 18C down-converts (level-shifts) the second DC voltage of the battery 12 to a transistor logic voltage (e.g., the first DC voltage of about 5 V). The transistor logic voltage generated by the DC-DC converter 18C is provided to the controller 18B so that the controller 18B can operate stably. In order to generate the transistor logic voltage stably using the second DC voltage, the DC-DC converter 18C includes a switched-mode power supply (SMPS). Alternatively, the DC-DC converter 18C may include a resistor-based voltage divider.

The motor 20 is driven by phase voltage signals PVSs from the inverter 18A of the motor driver 18 to generate rotational force (i.e., rotational torque) that will be transmitted to the collecting fan 22. A switched reluctance motor of at least two phases is used as the motor 20. The switched reluctance motor 20 generates the at least two phase sensing signals PSSs. For example, two phase sensing signals PSSs are generated by the switched reluctance motor 20. The switched reluctance motor 20 also generates the start sensing signal and the operation sensing signal as well as the phase sensing signals PSSs. The phase of the start sensing signal is later by 30° to 50° than the phase of the first phase sensing signal PSS and is earlier by 40° to 60° than the phase of the second phase sensing signal PSSs. The operation sensing signal has the same phase and period as one of the phase sensing signals. The operation sensing signal generated by the switched reluctance motor 20 has the same phase and period as the first phase sensing signal PSSs. When the voltage of the battery 12 (i.e., the second DC voltage of 28 to 50 V) is used, the switched reluctance motor 20 has at least two coils with a characteristic impedance that is low enough to rotate the motor at a desired rotation speed (or to generate a desired rotational force). For example, the first and second coils in the switched reluctance motor 20 are alternately excited by the first and second phase voltage signals PVSS. Accordingly, the switched reluctance motor 20 is rotated at a desired rotation speed (e.g., 7000 to 9000 rpm) by PWM-mode phase voltage signals PVSs as well as by trigger-pulse-mode phase voltage signals PVSs with an average voltage of 28 to 50 V, thereby generating the rotational force with a desired strength. The use of the PWM-mode phase voltage signals PVSs can solve the problem of heat that is generated when the motor 20 rotates at a speed of 7000 to 9000 rpm in the AC voltage mode. In addition, the switched reluctance motor 20 with the low-characteristic-impedance coils is rotated at a desired speed by the phase voltage signal PVS of a PWM component, thereby making it possible to generate a desired rotational force by the voltage of the battery 12 as well as by the AC voltage.

The collecting fan 22 is rotated by the rotational force (or rotational torque) of the motor 20 to generate inhalation (suction) force. This inhalation force causes pollutant particles (e.g., dust and dirt) to be collected into the collecting space (not illustrated) of the cleaner. The rotational force with a desired strength is supplied from the switched reluctance motor 20 with the low-characteristic-impedance coils by using the voltage of the battery 12 as well as by using the AC voltage. Accordingly, the collecting fan 22 can generate the inhalation force with a desired strength by using the voltage of the battery 12 as well as by using the AC voltage, thereby making it possible to reduce the time taken to clean up pollutant particles using the voltage of the battery 12 to about the time taken to clean up the pollutant particles using the AC voltage.

The cleaner further includes a charger 24 connected between the power cord 11 and the battery 12, and a forcible interrupter 26 connected between the controller 18B and the inverter 18A. In the AC voltage mode where the AC voltage is supplied through the power cord 11, the charger 24 performs a rectifying/smoothing operation to convert the AC voltage into a DC voltage. In addition, the charger 16 supplies the DC voltage to the battery 12 to charge the battery 12.

Figure 2:
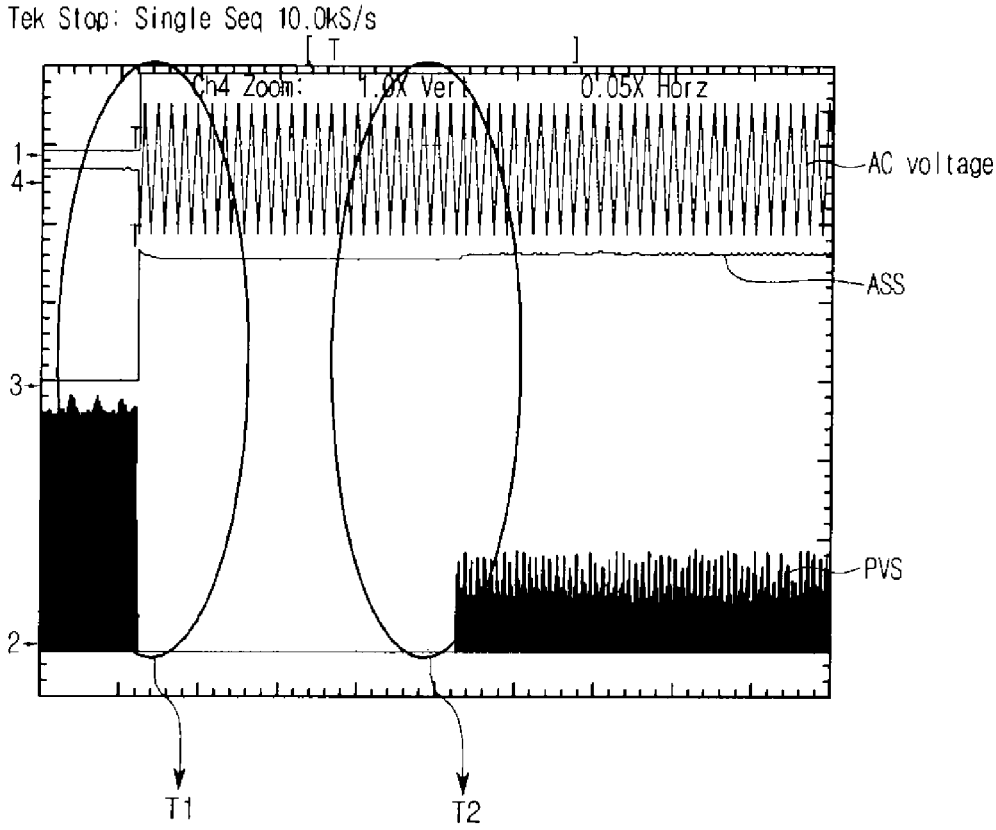
FIGS. 2 to 4 are waveform diagrams of motor driving signals that are provided to a motor.
Figure 3:
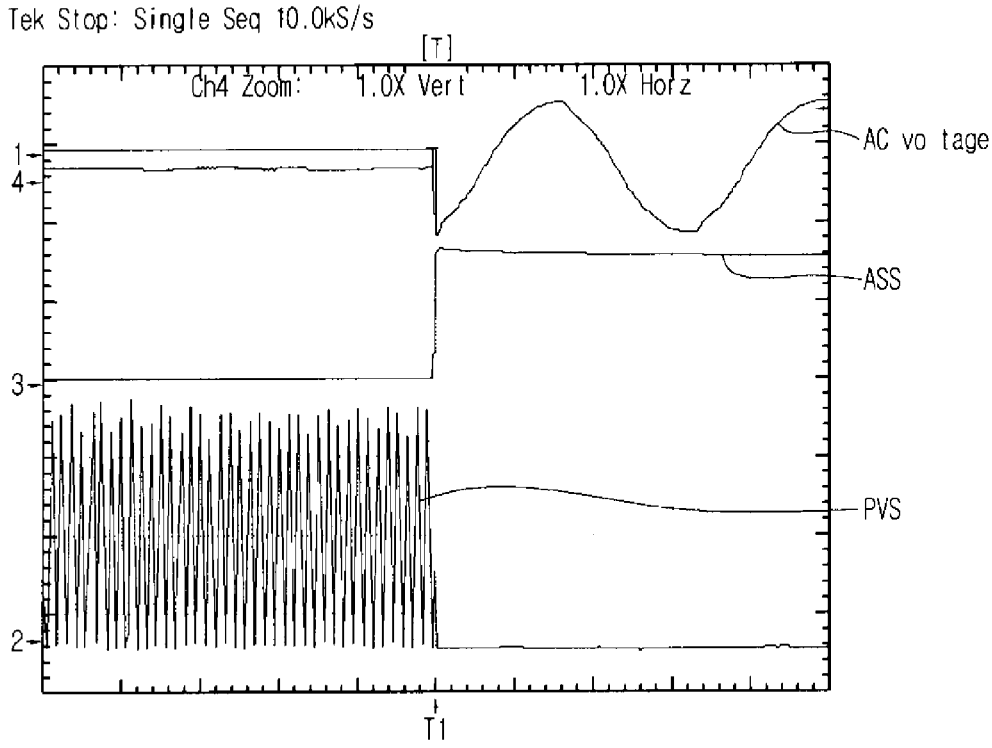
Figure 4:
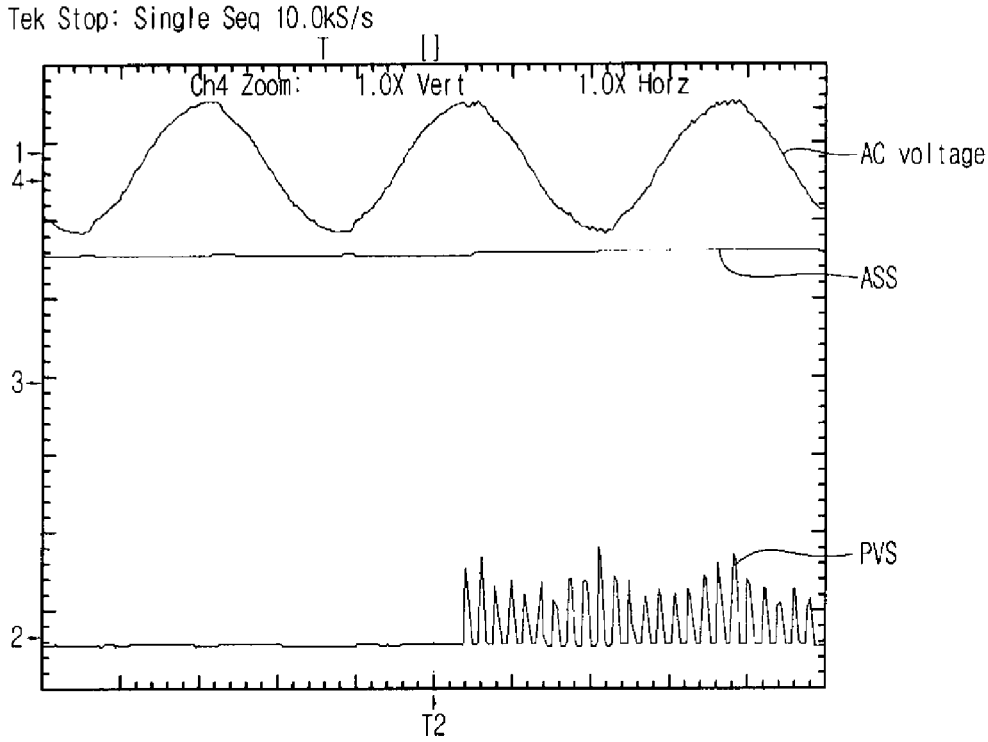

On the basis of the AC voltage detection signal ASS from the detector 16, the forcible interrupter 26 detects the time point when the first DC voltage converted from the AC voltage starts to be used instead of the second DC voltage of the battery 12. During a predetermined time from the time point when the first DC voltage converted from the AC voltage starts to be used instead of the second DC voltage of the battery 12, the forcible interrupter 26 interrupts at least two phase control signals PCSs to be provided from the controller 18B to the inverter 18A, outputting a forcible interrupt phase control signal SPCS so that the phase voltage signal PVS is not provided from the inverter 18A to the switched reluctance motor 20. Accordingly, the switched reluctance motor 20 is not driven during the predetermined time from the time point when the first DC voltage converted from the AC voltage starts to be used instead of the second DC voltage of the battery 12 (i.e., the time point of change from the DC voltage mode into the AC voltage mode). As illustrated in FIG. 2, from the time when the AC voltage is supplied from a time point T1, the first DC voltage from the AC-DC converter 10, instead of the second DC voltage of the battery 12, is provided to the inverter 18A. During a predetermined period from the time point T1 to a time point T2, the forcible interrupter 26 interrupts at least two phase voltage signals PCSs to be provided from the controller 18B to the inverter 18A, so that the phase voltage signal PVS is not provided to the switched reluctance motor 20. From the time point T2, the forcible interrupter 26 provides at least two phase control signals PCSs from the controller 18B to the inverter 18A such that the switched reluctance motor 20 is driven by at least two phase voltage signals PVSs. In addition, the switched reluctance motor 20 is driven by the phase voltage signal PVSs of a PWM component till the time point T1 as illustrated in FIG. 3, while it is driven by the phase voltage signal PVS of a trigger pulse after the time point T2 as illustrated in FIG. 4. This is to prevent the first DC voltage (converted from the AC voltage) from being Inverted by the PWM-mode phase voltage signal PVS because the controller 18B is late in detecting the time point of change from the DC voltage mode into the AC voltage mode. In result, the generation of the phase voltage signal PVS of an excessively-high voltage, which may be generated during a predetermined period from the time point of change from the DC voltage mode into the AC voltage mode, is suppressed to prevent damage to the low-characteristic-impedance coils of the switched reluctance motor 20.

Figure 5:
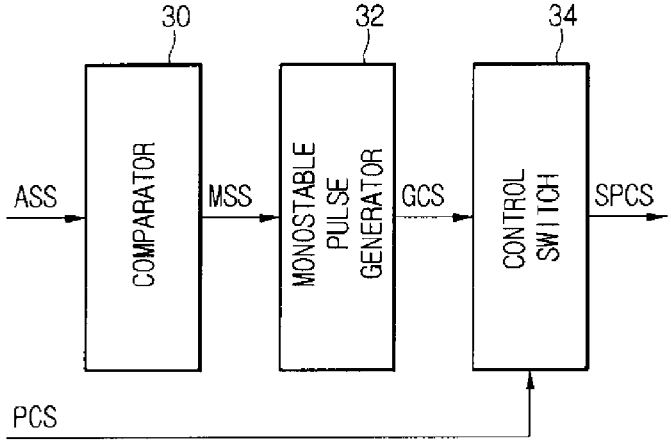
FIG. 5 is a block diagram of an embodiment of a forcible interrupter illustrated in FIG. 1.

FIG. 5 is a block diagram of an embodiment of the forcible interrupter 26 illustrated in FIG. 1.

Referring to FIG. 5, the forcible interrupter 26 includes a comparator 30, a monostable pulse generator 32, and a control switch 34.

Figure 6:
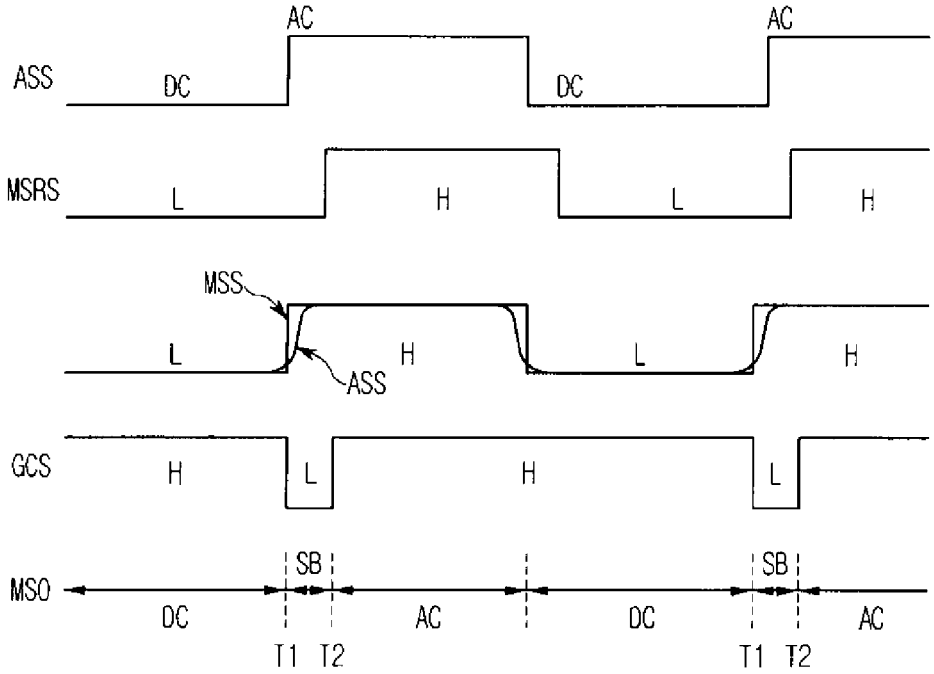
FIG. 6 is a waveform diagram of an I/O signal of each part in FIG. 5.

The comparator 30 compares the AC voltage detection signal ACC from the detector 16 (FIG. 1) with a predetermined reference voltage (not illustrated) to generate a mode switch signal MSS. The mode switch signal MSS has a high logic level while the AC voltage is being supplied to the power cord 11, but has a low logic level while the AC voltage is not being supplied to the power cord 11. As illustrated in FIG. 6, in synchronization with the mode switch signal MSS, the active voltage selector 14 (FIG. 1) alternately selects the DC voltage of the battery 12 and the first DC voltage converted from the AC voltage.

The monostable pulse generator 32 generates a gate control signal GCS with a gate pulse of a low (or high) logic level during a predetermined period from a rising edge of the mode switch signal MSS (i.e., the time point T1 when the AC voltage is supplied) to the time point T2. The width of the gate pulse in the gate control signal GCS is preset by the manufacturer to the extent that the user cannot detect the stop of the switched reluctance motor 20.

Depending on the logic value of the gate control signal GCS from the monostable pulse generator 32, the control switch 34, which outputs an SPCS control signal, interrupts at least two phase control signals PCSs from the controller 18B (FIG. 1) or provides the same to the inverter 18A (FIG. 1). For example, during the period of a logically-low gate pulse in the gate control signal GCS (i.e., the time period from the time point T1 to the time point T2), the control switch 34 interrupts at least two phase control signals to be provided from the controller 18B to the inverter 18A. Accordingly, as in MSO of FIG. 6, during the predetermined period (T1-T2) from the time point T1 (when the AC voltage starts to be supplied to the power cord 11) to the time point T2, the switched reluctance motor 20 is in a standby (SB) mode where it is not driven. This SB mode is to prevent the first DC voltage (converted from the AC voltage) from being inverted by the PWM-mode phase voltage signal PVS because the controller 18B is late in detecting the time point of change from the DC voltage mode into the AC voltage mode. In result, the generation of the phase voltage signal PVS of an excessively-high voltage, which may be generated during a predetermined period from the time point of change from the DC voltage mode into the AC voltage mode, is suppressed to prevent damage to the low-characteristic-impedance coils of the switched reluctance motor 20.

Figure 7:
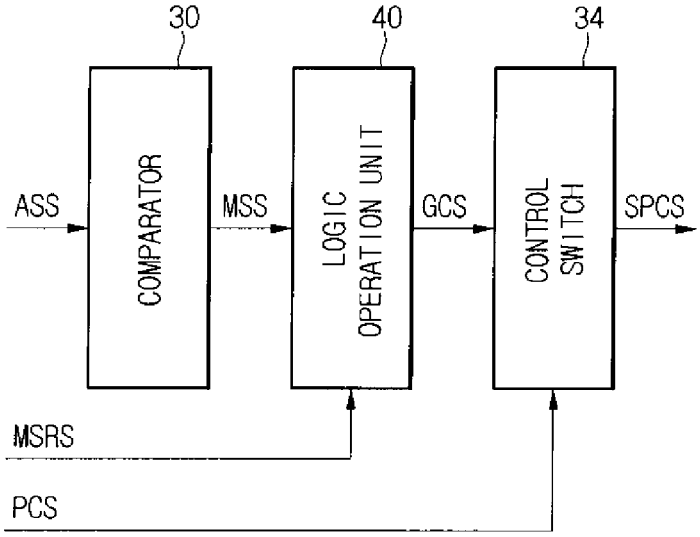
FIG. 7 is a block diagram of another embodiment of the forcible interrupter illustrated in FIG. 1.

FIG. 7 is a block diagram of another embodiment of the forcible interrupter 26 illustrated in FIG. 1. The forcible interrupter of FIG. 7 is similar to the forcible interrupter of FIG. 5 with the exception that it includes a logic operation unit 40 instead of the monostable pulse generator 32. A description of the same components as in FIG. 5 will be omitted for simplicity of description.

The logic operation unit 40 receives a mode switch recognition signal MSRS from the controller 18B (FIG. 1) as well as the mode switch signal MSS from the comparator 30. The controller 18B generates the mode switch recognition signal MSRS by determining the supply period of the AC voltage on the basis of the AC voltage detection signal ASS from the detector 16. That is, because the controller 18B performs a logic operation, it generates the mode switch recognition signal MSRS by detecting the time point when the AC voltage starts to be supplied, after the elapse of the predetermined period (T1-T2). Using the mode switch signal MSS and the mode switch recognition signal MSRS, the logic operation unit 40 generates the gate control signal GCS for setting the period of the SB mode, as illustrated in FIG. 6. To this end, the logic operation unit 40 exclusive-ORs or exclusive-NORs the mode switch signal MSS and the mode switch recognition signal MSRS, and ORs or ANDs the result and one of the mode switch signal MSS and the mode switch recognition signal MSRS.

Then, during the period of a logically-low gate pulse in the gate control signal GCS from the logic operation unit 40 (i.e., the period from the time point T1 to the time point T2) the control switch 34 interrupts at least two or more signals to be provided from the controller 18B to the inverter 18A. Accordingly, as in MSO of FIG. 6, during the predetermined period (T1-T2) from the time point T1 (when the AC voltage starts to be supplied to the power cord 11) to the time point T2, the switched reluctance motor 20 is in a standby (SB) mode where it is not driven. This SB mode is to prevent the first DC voltage (converted from the AC voltage) from being inverted by the PWM-mode phase voltage signal PVS because the controller 18B is late in detecting the time point of change from the DC voltage mode into the AC voltage mode. In result, the generation of the phase voltage signal of an excessively-high voltage, which may be generated during a predetermined period from the time point of change from the DC voltage mode into the AC voltage mode, is suppressed to prevent damage to the low-characteristic-impedance coils of the switched reluctance motor 20.

As described above, the cleaner according to the present disclosure actively selects the voltage of the battery and the DC voltage converted from the AC voltage and drives the switched reluctance motor by the selected voltage. Accordingly, the cleaner according to the present disclosure can automatically switch the AC voltage mode and the DC voltage mode and can increase the convenience of the user.

The cleaner according to the present disclosure uses the switched reluctance motor that has the sufficiently-low characteristic impedance to generate the desired rotational force by the voltage of the battery. Also, in the AC voltage mode where the AC voltage is supplied, the cleaner according to the present disclosure drops the DC voltage of about 310 V to about 28 to 50 V (i.e., the voltage of the battery) and supplies the same voltage to the switched reluctance motor. Accordingly, the switched reluctance motor can generate the desired rotational force by the voltage of the battery as well as by the AC voltage. Likewise, the collecting fan can generate the inhalation force with the desired strength by using the voltage of the battery as well as by using the AC voltage. Consequently, the cleaner according to the present disclosure can have the sufficiently-high capability of collecting pollutant particles and can reduce the time taken to clean up pollutant particles using the voltage of the battery 12 to about the time taken to clean up the pollutant particles using the AC voltage.

In addition, the cleaner according to the present disclosure goes through the temporary stop mode for preventing the excessively-high voltage from being applied to the low-characteristic-impedance motor, before entry into the AC voltage mode. Accordingly, the cleaner according to the present disclosure can interrupt the excessive voltage driving that may occur in the switching operation between the AC voltage mode and the DC voltage mode, thereby making it possible to prevent the occurrence of breakdown, malfunction and component damage.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The present disclosure relates to subject matter contained in Korean Patent Application No. 10-2007-0053851, filed Jun. 1, 2007, the disclosure of which is expressly incorporated herein by reference, in its entirety.

What is claimed is:

1. A cleaner, comprising:

a motor configured to rotate a collecting fan;

a battery configured to provide a first DC voltage;

a voltage converter configured to convert an AC voltage received from a power source into a second DC voltage;

a voltage selector configured to select one of the first DC voltage and the second DC voltage; and a driver configured to selectively drop the selected voltage based on a status of the AC voltage and to drive the motor using one of the selected voltage and the selectively dropped voltage, wherein the driver comprises:

an inverter configured to generate at least two phase voltage signals to be supplied to the motor using the selected voltage; and a controller configured to control the inverter to selectively drop an average voltage of the at least two phase voltage signals based on a status of the AC voltage.

2. The cleaner according to claim 1, wherein the voltage selector comprises a unidirectional device configured to interrupt the first DC voltage, which is applied from the battery to the driver, based on a state of the AC voltage.

3. The cleaner according to claim 1, further comprising:

a charger configured to charge the battery using the AC voltage.

4. The cleaner according to claim 1, wherein, when the status of the AC voltage indicates that the AC voltage is not received, the controller is configured to control the inverter to generate the at least two phase voltage signals using the selected voltage, and when the status of the AC voltage indicates that the AC voltage is received, the controller is configured to control the inverter to drop the selected voltage and to generate the at least two phase voltage signals using the dropped voltage.

5. The cleaner according to claim 1, further comprising:

a DC-DC converter configured to down-convert the first DC voltage and to provide a down-converted DC voltage to the controller.

6. A cleaner comprising:

a motor configured to rotate a collecting fan;

a battery configured to provide a first DC voltage;

a voltage converter configured to convert an AC voltage received from a power source into a second DC voltage;

a driver configured to drive the motor using one of the first DC voltage and the second DC voltage based on a status of the AC voltage; and an interrupter configured to disconnect the driver from the motor for a predetermined time period from a point in which a switching operation has been completed between the first DC voltage and the second DC voltage, wherein the driver comprises:

an inverter configured to generate at least two phase voltage signals, which are to be supplied to the motor using one of the first DC voltage and the second DC voltage; and a controller configured to control the inverter to selectively drop an average voltage of the at least two phase voltage signals based on the status of the AC voltage.

7. The cleaner according to claim 6, wherein the motor is one of a switched reluctance motor and a resistance-mode motor comprising a commutator coil with a characteristic impedance adapted for generating a rotational force or a driving torque using the first DC voltage.

8. The cleaner according to claim 6, wherein the interrupter comprises:

a switch timing detector configured to detect a switch time point at which the switch is made between the first DC voltage and the second DC voltage based on the status of the AC voltage; and a switch configured to electrically disconnect the driver from the motor during the predetermined period from the detected switch time point.

9. The cleaner according to claim 8, wherein the switch comprises:

a disconnection period determiner configured to set the predetermined time period in response to a detection result from the switch timing detector; and a control switch configured to electrically disconnect the driver from the motor in response to an output signal of the disconnection period determiner.

10. The cleaner according to claim 6, wherein the driver is further configured to selectively drop one of the first DC voltage and the second DC voltage based on status of the AC voltage, and to drive the motor using one of the selectively dropped voltage and the other voltage.

11. The cleaner according to claim 6, wherein, when the status of the AC voltage indicates that the AC voltage is received, the controller is configured to control the inverter to drop the average voltage of the at least two phase voltage signals.

12. The cleaner according to claim 6, wherein the controller is configured to control the inverter to adjust the phase of the at least two phase voltage signals on the basis of a signal received from the motor.

13. The cleaner according to claim 6, wherein the interrupter comprises:

a switch timing detector configured to detect a switch time point at which a switch is made between the first DC voltage and the second DC voltage based on a status of the AC voltage, the switch timing detector generating a detection signal; and a switch configured to temporarily interrupt a control signal to be provided from the controller to the inverter on the basis of the detection signal and a timing detection signal from the controller.

14. The cleaner according to claim 13, wherein the switch comprises:

an interruption period determiner configured to set an interruption period by logically operating based on the detection signal and the timing detection signal; and a control switch configured to interrupt the control signal to be provided from the controller to the inverter in response to an output signal of the interruption period determiner.

15. The cleaner according to claim 13, wherein the switch interrupts the control signal to be provided to the inverter during a predetermined period based on the status of the AC voltage.

16. The cleaner according to claim 6 further comprising:

a DC-DC converter configured to down-convert the first DC voltage to a resulting voltage, and to provide the resulting voltage to the controller and the interrupter.

17. The cleaner according to claim 6, further comprising:

a detector configured to detect the status of the AC voltage on the basis of a voltage from one of the power source and the voltage converter, and providing the detection result to the driver and the interrupter.

18. The cleaner according to claim 17, wherein the detector is implemented using an operation program of the driver.

* * * * *